US011267547B2

(12) United States Patent
Motose et al.

(10) Patent No.: US 11,267,547 B2
(45) Date of Patent: Mar. 8, 2022

(54) OUTBOARD MOTOR AND MARINE VESSEL

(71) Applicant: YAMAHA HATSUDOKI KABUSHIKI KAISHA, Iwata (JP)

(72) Inventors: Hitoshi Motose, Shizuoka (JP); Ryuma Teramoto, Shizuoka (JP); Masahisa Watanabe, Shizuoka (JP)

(73) Assignee: YAMAHA HATSUDOKI KABUSHIKI KAISHA, Iwata (JP)

( * ) Notice: Subject to any disclaimer, the term of this patent is extended or adjusted under 35 U.S.C. 154(b) by 12 days.

(21) Appl. No.: 17/092,535

(22) Filed: Nov. 9, 2020

(65) Prior Publication Data

US 2021/0147053 A1 May 20, 2021

(30) Foreign Application Priority Data

Nov. 14, 2019 (JP) ..... JP2019-206272

(51) Int. Cl.

| | |
|---|---|
| ***B63H 20/10*** | (2006.01) |
| ***B63H 20/02*** | (2006.01) |
| ***B63H 1/14*** | (2006.01) |
| ***B63H 20/32*** | (2006.01) |
| ***B63B 79/10*** | (2020.01) |
| ***B63B 79/40*** | (2020.01) |

(Continued)

(52) U.S. Cl.

CPC ..... *B63H 20/10* (2013.01); *B63B 79/10* (2020.01); *B63B 79/40* (2020.01); *B63H 1/14* (2013.01); *B63H 3/00* (2013.01); *B63H 20/02* (2013.01); *B63H 20/32* (2013.01); *B63H 23/34* (2013.01)

(58) Field of Classification Search

CPC ..... B63H 20/10; B63H 20/02; B63H 20/32; B63H 1/14; B63H 3/00; B63H 23/34; B63B 79/40; B63B 79/10

See application file for complete search history.

(56) References Cited

U.S. PATENT DOCUMENTS 6,220,904 B1 * 4/2001 Hoshiba ..... F02B 61/045 440/1

6,343,966 B1 * 2/2002 Martin ..... F01P 5/12 440/88 A (Continued)

FOREIGN PATENT DOCUMENTS

| | | |
|---|---|---|
| JP | 2004-211619 A | 7/2004 |
| JP | 4353516 B2 | 10/2009 |
| JP | 5082553 B2 | 11/2012 |

*Primary Examiner* — Stephen P Avila

(74) *Attorney, Agent, or Firm* — Rabin & Berdo, P.C.

(57) ABSTRACT

An outboard motor includes an engine, and a propeller driven by the engine via a drive shaft and a propeller shaft, a tilting mechanism that changes a tilt angle of the propeller shaft and/or the drive shaft, a triaxial acceleration sensor and a triaxial angular velocity sensor, and a controller. The controller is configured to acquire at least one of a gravity direction, a traveling direction, or a horizontal direction of the hull using the triaxial acceleration sensor, and detect at least one of a first angle of the drive shaft with respect to the gravity direction, a second angle of the propeller shaft with respect to the traveling direction, or a third angle of the propeller shaft with respect to the horizontal direction using the triaxial angular velocity sensor, to thereby control the tilting mechanism to adjust the tilt angle of the drive shaft and/or the propeller shaft.

20 Claims, 7 Drawing Sheets

FIRST (SECOND) PREFERRED EMBODIMENT

(51) Int. Cl.
*B63H 3/00* (2006.01)
*B63H 23/34* (2006.01)

(56) References Cited

U.S. PATENT DOCUMENTS

2012/0022820 A1* 1/2012 Schmitz ..... G01C 21/165
702/95
2018/0251212 A1* 9/2018 Sugaki ..... B64C 27/08

* cited by examiner

FIRST (SECOND) PREFERRED EMBODIMENT

FIRST PREFERRED EMBODIMENT

SECOND PREFERRED EMBODIMENT

OUTBOARD MOTOR AND MARINE VESSEL

CROSS REFERENCE TO RELATED APPLICATIONS

This application claims the benefit of priority to Japanese Patent Application No. 2019-206272 filed on Nov. 14, 2019. The entire contents of this application are hereby incorporated herein by reference.

BACKGROUND OF THE INVENTION

1. Field of the Invention

The present invention relates to an outboard motor including a tilting mechanism, and a marine vessel.

2. Description of the Related Art

An outboard motor including a tilting mechanism is known in general. Such an outboard motor is disclosed in Japanese Patent Laid-Open No. 2004-211619, for example.

Japanese Patent Laid-Open No. 2004-211619 discloses an outboard motor including an outboard motor body including a propeller, and an actuator (tilting mechanism) that tilts the outboard motor body together with the propeller.

Although not clearly described in Japanese Patent Laid-Open No. 2004-211619, in the field of outboard motors, conventionally, an attitude angle sensor (IMU, i.e., an acceleration sensor and an angular velocity sensor) that measures the tilt angle of a hull is installed on the hull to manually measure the mounting angle of an outboard motor with respect to the hull, a measurement value of the attitude angle sensor is corrected based on the mounting angle of the outboard motor with respect to the hull, and the tilt angle of the propeller (propeller shaft) is detected. However, there is a concern that an error in detection of the tilt angle of the propeller shaft increases due to both an error in manual measurement by the attitude angle sensor and an error in measurement of the mounting angle of the outboard motor with respect to the hull. Furthermore, as described above, it is necessary to manually measure the mounting angle of the outboard motor with respect to the hull, and the workload on a user is large.

SUMMARY OF THE INVENTION

Preferred embodiments of the present invention provide outboard motors and marine vessels that reduce the workload on users who manually measure the mounting angles of the outboard motors with respect to hulls, and improve the detection accuracy of the tilt angles of at least one of propeller shafts and drive shafts.

An outboard motor according to a preferred embodiment of the present invention includes an engine, a propeller driven by the engine via a drive shaft and a propeller shaft, a tilting mechanism that changes a tilt angle of at least one of the propeller shaft (the rotation center axis of the propeller) and the drive shaft by moving an outboard motor body with respect to a hull, a triaxial acceleration sensor and a triaxial angular velocity sensor installed in the outboard motor body, and a controller configured or programmed to acquire at least one of a gravity direction, a traveling direction, and a horizontal direction of the hull using the triaxial acceleration sensor and detect at least one of the tilt angle of the drive shaft with respect to the gravity direction, the tilt angle of the propeller shaft with respect to the traveling direction, and the tilt angle of the propeller shaft with respect to the horizontal direction using the triaxial angular velocity sensor so as to control the tilting mechanism to adjust the tilt angle of at least one of the drive shaft and the propeller shaft.

As described above, an outboard motor according to a preferred embodiment of the present invention includes the tilting mechanism that changes the tilt angle of at least one of the propeller shaft and the drive shaft by moving the outboard motor body with respect to the hull, and the triaxial acceleration sensor and the triaxial angular velocity sensor installed in the outboard motor body. Accordingly, the triaxial acceleration sensor and the triaxial angular velocity sensor are installed in the outboard motor body instead of the hull, and thus it is not necessary to correct a measurement value of an attitude angle sensor (IMU, i.e., the acceleration sensor and the angular velocity sensor) installed on the hull with the mounting angle of the outboard motor with respect to the hull measured manually, unlike the related art. That is, the tilt angle of at least one of the propeller shaft and the drive shaft is directly detected by the triaxial acceleration sensor and the triaxial angular velocity sensor directly installed in the outboard motor body, and thus an error in detection of the tilt angle of at least one of the propeller shaft and the drive shaft includes only an error in measurement by each of the triaxial acceleration sensor and the triaxial angular velocity sensor. Furthermore, it is not necessary to manually measure the mounting angle of the outboard motor with respect to the hull. Thus, the workload on a user who manually measures the mounting angle of the outboard motor with respect to the hull is reduced, and the detection accuracy of the tilt angle of at least one of the propeller shaft and the drive shaft is improved.

In an outboard motor according to a preferred embodiment of the present invention, the controller is preferably configured or programmed to perform at least one of a control to move the tilt angle of the drive shaft closer to the gravity direction, a control to move the tilt angle of the propeller shaft closer to the traveling direction, and a control to move the tilt angle of the propeller shaft closer to the horizontal direction. Accordingly, the tilt angle of at least one of the propeller shaft and the drive shaft with respect to a reference direction (the gravity direction, the traveling direction, or the horizontal direction) is reduced, and propulsion of a marine vessel with the propeller shaft or the drive shaft being tilted is significantly reduced or prevented. Therefore, the marine vessel is stably propelled.

In such a case, the controller is preferably configured or programmed to perform at least one of a control to match the tilt angle of the drive shaft with the gravity direction, a control to match the tilt angle of the propeller shaft with the traveling direction, and a control to match the tilt angle of the propeller shaft with the horizontal direction. Accordingly, the tilt angle of at least one of the propeller shaft and the drive shaft is matched with the reference direction (the gravity direction, the traveling direction, or the horizontal direction), and propulsion of the marine vessel with the propeller shaft or the drive shaft being tilted is prevented. Therefore, the marine vessel is more stably propelled.

In an outboard motor including the controller configured or programmed to perform a control to reduce the tilt angle of at least one of the propeller shaft and the drive shaft, the controller is preferably configured or programmed to acquire the horizontal direction using the triaxial acceleration sensor and detect a pitch angle of the propeller shaft with respect to the horizontal direction as viewed in a right-left direction of the outboard motor body using the triaxial angular velocity sensor so as to perform a control to move the pitch angle of the propeller shaft closer to the horizontal direction such that a thrust force of the propeller is along the horizontal direction. Accordingly, the thrust force of the propeller is along the horizontal direction such that a component of the thrust force of the propeller in the gravity direction (upward-downward direction) is reduced. Consequently, a loss in the thrust force of the propeller is reduced, and the marine vessel is efficiently propelled.

In such a case, the tilting mechanism preferably includes a trim mechanism that changes the tilt angle of the propeller shaft by rotating the outboard motor body in an upward-downward direction of the outboard motor body about an axis that extends in the right-left direction, and the controller is preferably configured or programmed to drive the trim mechanism and perform a control to move the pitch angle of the propeller shaft closer to the horizontal direction. Accordingly, the trim mechanism easily changes the pitch angle of the propeller shaft to adjust the tilt angle of the propeller shaft.

In an outboard motor including the controller configured or programmed to perform a control to reduce the tilt angle of at least one of the propeller shaft and the drive shaft, the controller is preferably configured or programmed to acquire the traveling direction of the hull using the triaxial acceleration sensor and detect a yaw angle of the propeller shaft with respect to the traveling direction as viewed in an upward-downward direction of the outboard motor body using the triaxial angular velocity sensor so as to perform a control to move the yaw angle of the propeller shaft closer to the traveling direction such that a thrust force of the propeller is along the traveling direction. Accordingly, the thrust force of the propeller is along the traveling direction such that the marine vessel is propelled linearly (propelled straight) without steering (without check helm) when the wind is relatively weak. That is, the marine vessel is easily operated.

In such a case, the tilting mechanism preferably includes a steering mechanism that changes the tilt angle of the propeller shaft by rotating the outboard motor body in a right-left direction of the outboard motor body about an axis that extends in the upward-downward direction, and the controller is preferably configured or programmed to drive the steering mechanism and perform a control to move the yaw angle of the propeller shaft closer to the traveling direction. Accordingly, the steering mechanism easily changes the yaw angle of the propeller shaft to adjust the tilt angle of the propeller shaft.

In an outboard motor including the controller configured or programmed to perform a control to reduce the tilt angle of at least one of the propeller shaft and the drive shaft, the controller is preferably configured or programmed to acquire the gravity direction of the hull using the triaxial acceleration sensor and detect a roll angle of the drive shaft with respect to the gravity direction as viewed in a forward-rearward direction of the outboard motor body using the triaxial angular velocity sensor so as to perform a control to move the roll angle of the drive shaft closer to the gravity direction. Accordingly, the propeller shaft is disposed in a balanced manner with respect to the hull in the right-left direction (when there is one outboard motor, the propeller shaft is disposed at the center with respect to the hull), and thus the marine vessel is easily propelled linearly (propelled straight). In addition, a large turn is significantly reduced or prevented such that the marine vessel is stably propelled.

An outboard motor according to a preferred embodiment of the present invention preferably further includes a unit case that houses and unitizes the triaxial acceleration sensor and the triaxial angular velocity sensor. Accordingly, the unit case unitizes the triaxial acceleration sensor and the triaxial angular velocity sensor such that the triaxial acceleration sensor and the triaxial angular velocity sensor are easily installed.

An outboard motor according to a preferred embodiment of the present invention preferably further includes a cowling that houses the engine, and the triaxial acceleration sensor and the triaxial angular velocity sensor are preferably housed in the cowling. Accordingly, the triaxial acceleration sensor and the triaxial angular velocity sensor are disposed at relatively easily accessible positions (easily reachable positions) inside the outboard motor.

In such a case, the triaxial acceleration sensor and the triaxial angular velocity sensor are preferably disposed above a lower end of the cowling so as to prevent contact with water. Accordingly, contact of the triaxial acceleration sensor and the triaxial angular velocity sensor with water is prevented.

In an outboard motor including the triaxial acceleration sensor and the triaxial angular velocity sensor disposed above the lower end of the cowling so as to prevent contact with water, the triaxial acceleration sensor and the triaxial angular velocity sensor are preferably installed on a left side surface, a right side surface, a rear side surface, a front side surface or a upper surface of the engine. Accordingly, the triaxial acceleration sensor and the triaxial angular velocity sensor are easily installed at positions inside the cowling that water does not contact.

In an outboard motor including the triaxial acceleration sensor and the triaxial angular velocity sensor disposed above the lower end of the cowling so as to prevent contact with water, the triaxial acceleration sensor and the triaxial angular velocity sensor are preferably installed on the engine via a vibration damper made of an elastic body that significantly reduces or prevents transmission of a vibration of the engine to the triaxial acceleration sensor and the triaxial angular velocity sensor. Accordingly, transmission of a vibration of the engine to the triaxial acceleration sensor and the triaxial angular velocity sensor is significantly reduced or prevented by the vibration damper.

In such a case, an outboard motor according to a preferred embodiment of the present invention preferably further includes a bracket on which the triaxial acceleration sensor and the triaxial angular velocity sensor are installed, the bracket being made of a resin and fixed to the engine via the vibration damper. Accordingly, an increase in the temperatures of the triaxial acceleration sensor and the triaxial angular velocity sensor due to the heat of the engine is significantly reduced or prevented by the bracket made of a resin while transmission of a vibration of the engine to the triaxial acceleration sensor and the triaxial angular velocity sensor is significantly reduced or prevented by the vibration damper.

In an outboard motor including the triaxial acceleration sensor and the triaxial angular velocity sensor disposed above the lower end of the cowling so as to prevent contact with water, the triaxial acceleration sensor and the triaxial angular velocity sensor are preferably disposed outward of an intake path in the cowling. Accordingly, vibrations of the triaxial acceleration sensor and the triaxial angular velocity sensor due to intake air that passes through the intake path are prevented.

A marine vessel according to a preferred embodiment of the present invention includes a hull and an outboard motor installed on the hull, and the outboard motor includes an engine, a propeller driven by the engine via a drive shaft and a propeller shaft, a tilting mechanism that changes a tilt angle of at least one of the propeller shaft and the drive shaft by moving an outboard motor body with respect to the hull, a triaxial acceleration sensor and a triaxial angular velocity sensor installed in the outboard motor body, and a controller configured or programmed to acquire at least one of a gravity direction, a traveling direction, and a horizontal direction of the hull using the triaxial acceleration sensor and detect at least one of the tilt angle of the drive shaft with respect to the gravity direction, the tilt angle of the propeller shaft with respect to the traveling direction, and the tilt angle of the propeller shaft with respect to the horizontal direction using the triaxial angular velocity sensor so as to control the tilting mechanism to adjust the tilt angle of at least one of the drive shaft and the propeller shaft.

As described above, a marine vessel according to a preferred embodiment of the present invention includes the tilting mechanism that changes the tilt angle of at least one of the propeller shaft and the drive shaft by moving the outboard motor body with respect to the hull, and the triaxial acceleration sensor and the triaxial angular velocity sensor installed in the outboard motor body. Thus, the workload on a user who manually measures the mounting angle of the outboard motor with respect to the hull is reduced, and the detection accuracy of the tilt angle of at least one of the propeller shaft and the drive shaft is improved.

In a marine vessel according to a preferred embodiment of the present invention, the controller is preferably configured or programmed to perform at least one of a control to move the tilt angle of the drive shaft closer to the gravity direction, a control to move the tilt angle of the propeller shaft closer to the traveling direction, and a control to move the tilt angle of the propeller shaft closer to the horizontal direction. Accordingly, the tilt angle of at least one of the propeller shaft and the drive shaft with respect to a reference direction (the gravity direction, the traveling direction, or the horizontal direction) is reduced, and propulsion of a marine vessel with the propeller shaft or the drive shaft being tilted is significantly reduced or prevented. Therefore, the marine vessel is stably propelled.

In such a case, the controller is preferably configured or programmed to perform at least one of a control to match the tilt angle of the drive shaft with the gravity direction, a control to match the tilt angle of the propeller shaft with the traveling direction, and a control to match the tilt angle of the propeller shaft with the horizontal direction. Accordingly, the tilt angle of at least one of the propeller shaft and the drive shaft is matched with the reference direction (the gravity direction, the traveling direction, or the horizontal direction), and propulsion of the marine vessel with the propeller shaft or the drive shaft being tilted is prevented. Therefore, the marine vessel is more stably propelled.

In an marine vessel including the controller configured or programmed to perform a control to reduce the tilt angle of at least one of the propeller shaft and the drive shaft, the controller is preferably configured or programmed to acquire the horizontal direction of the hull using the triaxial acceleration sensor and detect a pitch angle of the propeller shaft with respect to the horizontal direction as viewed in a right-left direction of the outboard motor body using the triaxial angular velocity sensor so as to perform a control to move the pitch angle of the propeller shaft closer to the horizontal direction such that a thrust force of the propeller is along the horizontal direction. Accordingly, the thrust force of the propeller is along the horizontal direction such that a component of the thrust force of the propeller in the gravity direction (upward-downward direction) is reduced. Consequently, a loss in the thrust force of the propeller is reduced, and the marine vessel is efficiently propelled.

In a marine vessel including the controller configured or programmed to perform a control to reduce the tilt angle of at least one of the propeller shaft and the drive shaft, the controller is preferably configured or programmed to acquire the traveling direction of the hull using the triaxial acceleration sensor and detect a yaw angle of the propeller shaft with respect to the traveling direction as viewed in an upward-downward direction of the outboard motor body using the triaxial angular velocity sensor so as to perform a control to move the yaw angle of the propeller shaft closer to the traveling direction such that a thrust force of the propeller is along the traveling direction. Accordingly, the thrust force of the propeller is along the traveling direction such that the marine vessel is propelled linearly (propelled straight) without steering (without check helm) when the wind is relatively weak.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of a marine vessel 100 according to a first preferred embodiment of the present invention is now described with reference to FIGS. 1 to 7.

Figure 1:
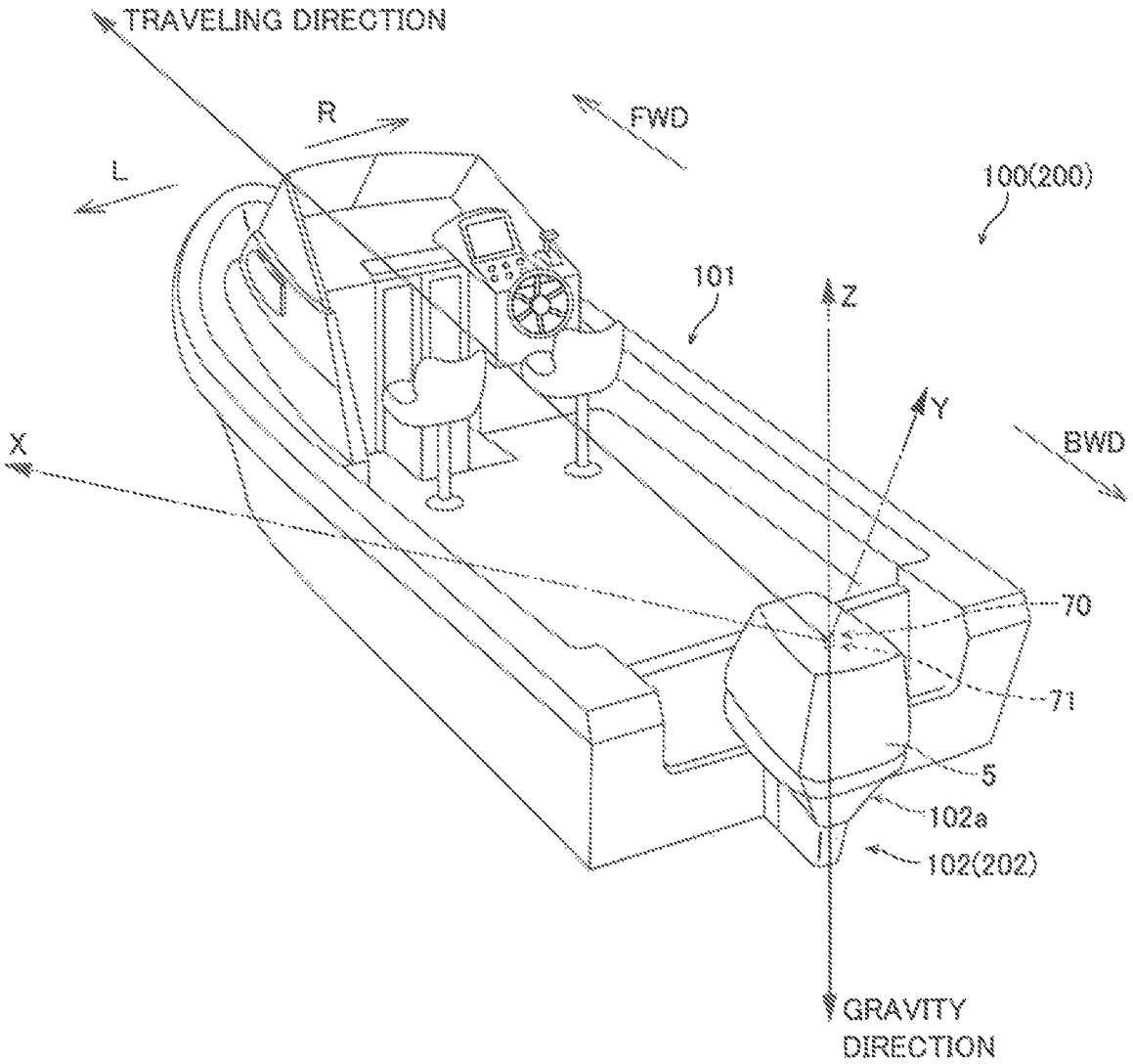
FIG. 1 is a perspective view schematically showing a marine vessel including a hull and an outboard motor according to first and second preferred embodiments of the present invention.

As shown in FIG. 1, the marine vessel 100 includes a hull 101 and one outboard motor 102 installed on the stern (transom) of the hull 101.

In the figures, arrow "FWD" represents a forward direction, which is the traveling direction of the marine vessel 100, and arrow "BWD" represents a rearward direction, which is an opposite direction to the forward direction. The traveling direction (forward direction) and the rearward direction are parallel to a horizontal direction.

In the figures, arrow "L" represents a leftward direction, which is the port-side direction of the marine vessel 100, and arrow "R" represents a rightward direction, which is the starboard-side direction of the marine vessel 100. The leftward direction and the rightward direction are parallel to the horizontal direction, and are perpendicular to a forward-rearward direction.

In FIG. 1, arrow "Z" represents an upward-downward direction, and arrow "X" and arrow "Y" perpendicular to each other represent the horizontal direction. The upward-downward direction and the horizontal direction (reference directions) do not change regardless of the state of the marine vessel 100.

Figure 2:
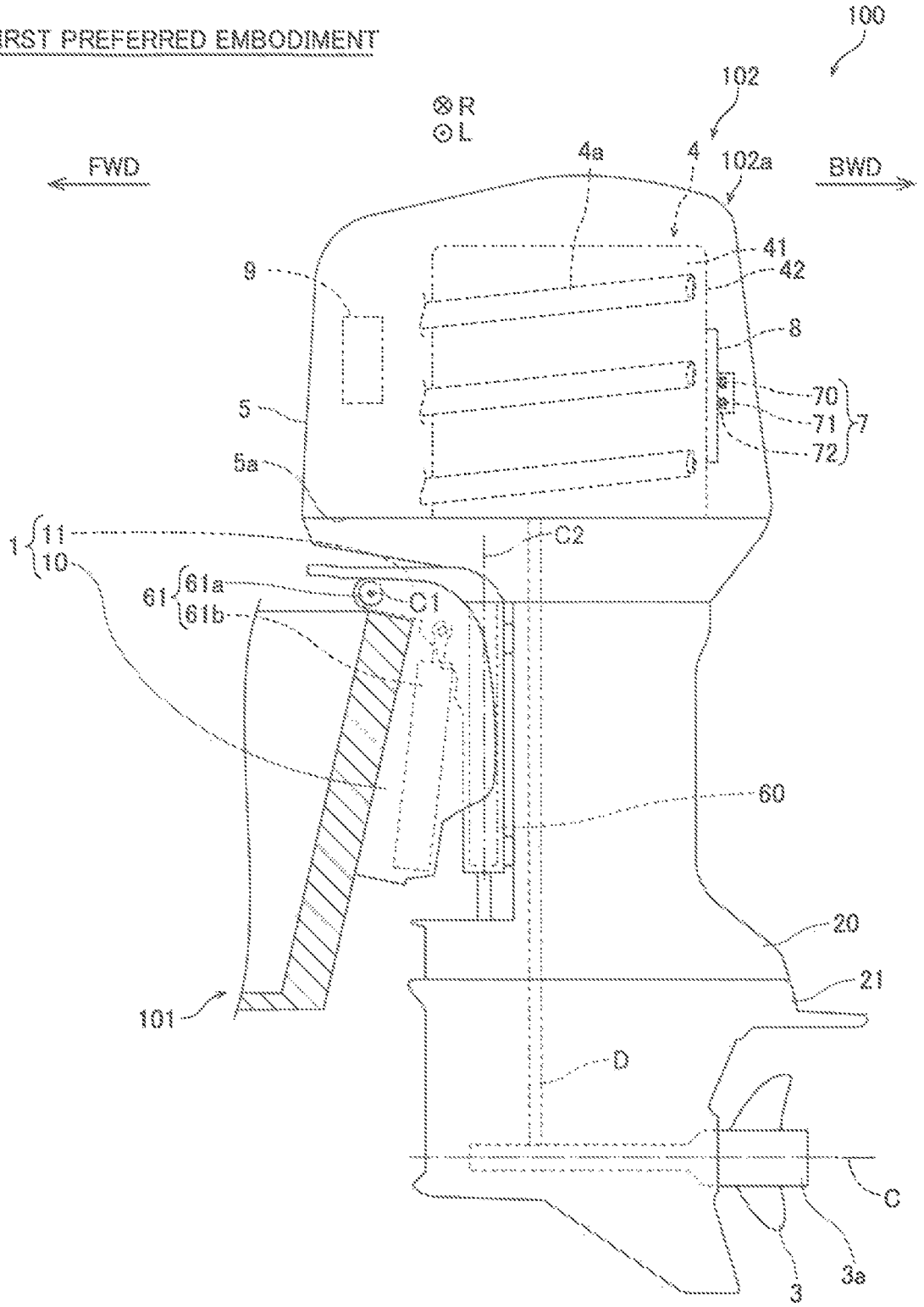
FIG. 2 is a side view showing the structure of the outboard motor according to the first preferred embodiment of the present invention.

As shown in FIG. 2, the marine vessel 100 obtains a thrust force by the outboard motor 102. The outboard motor 102 adjusts the traveling direction by changing the orientation of a propeller 3 of the outboard motor 102 in the upward-downward direction and a right-left direction. That is, the outboard motor 102 adjusts the traveling direction by changing the tilt angle of a propeller shaft 3*a* (the rotation center axis C of the propeller 3) of the outboard motor 102. The outboard motor 102 changes the tilt angle of the propeller shaft 3*a* by moving an outboard motor body 102*a* with respect to the hull 101 by a steering mechanism 60 and a trim mechanism 61 described below.

The outboard motor 102 includes a stern fixing bracket 1, an upper case 20, a lower case 21, the propeller 3, an engine 4, a cowling 5, the trim mechanism 61, the steering mechanism 60, an inertial measurement unit (IMU) 7 including a triaxial acceleration sensor 70 and a triaxial angular velocity sensor 71, a bracket 8 that mounts the IMU 7 on the outboard motor body 102*a*, and an ECU 9. The steering mechanism 60 and the trim mechanism 61 are examples of a "tilting mechanism". The ECU 9 is an example of a "controller".

The stern fixing bracket 1 includes a fixed bracket 10 fixed to the hull 101 and a movable bracket 11 rotatably connected to the fixed bracket 10 via a trim shaft 61*a*. The trim shaft 61*a* extends in the right-left direction.

The movable bracket 11 supports the outboard motor body 102*a*. The outboard motor body 102*a* is an object to be supported by the stern fixing bracket 1, and refers to the whole of the above-described components (the upper case 20, the lower case 21, the propeller 3, the engine 4, the cowling 5, the trim mechanism 61, the steering mechanism 60, the IMU 7, the bracket 8, and the ECU 9) of the outboard motor 102 excluding the stern fixing bracket 1.

The movable bracket 11 is connected to the fixed bracket 10 via the trim shaft 61*a* so as to be rotatable in the upward-downward direction about an axis C1 that extends in the right-left direction. That is, the outboard motor body 102*a* (propeller 3) is supported by the stern fixing bracket 1 so as to be rotatable in the upward-downward direction about the axis C1 that extends in the right-left direction.

The upper case 20 is directly supported by the bracket 8, and a drive shaft D is disposed inside the upper case 20. The drive shaft D has a rod shape that extends in the upward-downward direction.

The lower case 21 is disposed below (Z2 direction) the upper case 20. The propeller shaft 3*a* rotationally driven by the drive shaft D is disposed inside the lower case 21.

The propeller 3 is driven by the engine 4. The propeller 3 is installed on the propeller shaft 3*a*, and is disposed rearward (BWD) of the lower case 21. The propeller 3 rotates about the rotation center axis C of the propeller shaft 3*a*. The propeller 3 generates a thrust force rearward along the rotation center axis C.

The engine 4 is an internal combustion engine that generates a driving force by burning fuel to rotate the propeller 3 via the drive shaft D and the propeller shaft 3*a*. The engine 4 is disposed above the upper case 20. The IMU 7 is installed on the engine 4 via the bracket 8 described below.

Figure 3:
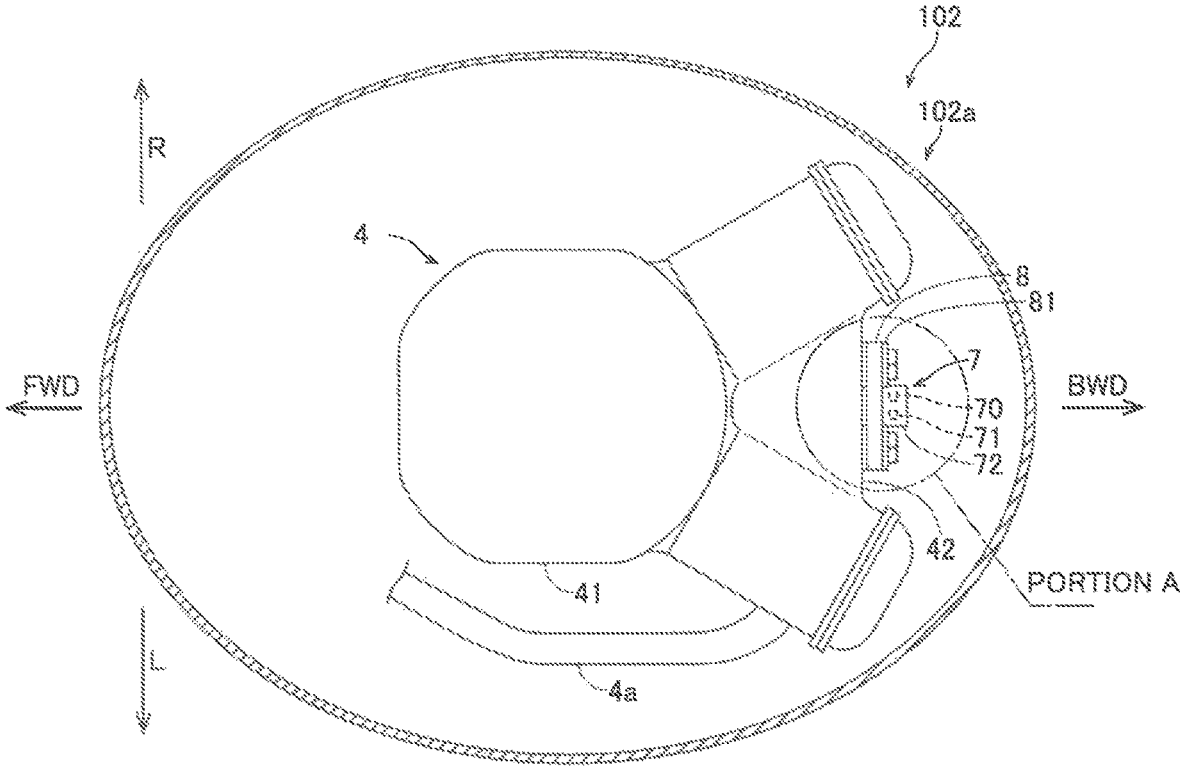
FIG. 3 is a diagram showing the inside of a cowling according to the first preferred embodiment of the present invention, as viewed from above.

As an example, the engine 4 shown in FIG. 3 is a multi-cylinder V-type or V-shaped engine in which a plurality of pistons (not shown) reciprocate in the horizontal direction and are disposed in a V-shape in a plan view.

A crankshaft (not shown) of the engine 4 is disposed forward of the plurality of pistons. Intake paths 4*a* through which air is taken in are disposed on the left side of the engine 4. The intake paths 4*a* are spaced apart from the left side surface 41 of the engine 4.

Again returning to FIG. 2, the cowling 5 houses the engine 4. Furthermore, the cowling 5 houses the IMU 7 (the triaxial acceleration sensor 70 and the triaxial angular velocity sensor 71) and the ECU 9. In the upward-downward direction, the lower end 5*a* of the cowling 5 is located at the uppermost position that is reachable by water when the marine vessel 100 is propelled. Therefore, the IMU 7 and the ECU 9 are disposed above at least the lower end 5*a* of the cowling 5 so as to prevent contact with water. The engine 4 is also disposed above the lower end 5*a* of the cowling 5.

The trim mechanism 61 changes the tilt angle of the propeller shaft 3*a* by rotating the outboard motor body 102*a* in the upward-downward direction about the axis C1 that extends in the right-left direction.

Specifically, the trim mechanism 61 includes the trim shaft 61*a* and a cylinder 61*b* that rotates the outboard motor body 102*a* about the trim shaft 61*a*. The axis C1 is the central axis of the trim shaft 61*a*. The trim mechanism 61 changes the tilt angle of the propeller shaft 3*a* by rotating the outboard motor body 102*a* in the upward-downward direction about the central axis (axis C1) of the trim shaft 61*a* that extends in the right-left direction by the cylinder 61*b*. In short, the trim mechanism 61 is a driving mechanism that changes the pitch angle (tilt angle) of the propeller 3.

The steering mechanism 60 changes the tilt angle of the propeller shaft 3*a* by rotating the outboard motor body 102*a* in the right-left direction about an axis C2 that extends in the upward-downward direction.

Specifically, the steering mechanism 60 includes a steering shaft that supports the movable bracket 11. The axis C2 is the central axis of the steering shaft. The steering mechanism 60 changes the tilt angle of the propeller shaft 3*a* by rotating the outboard motor body 102*a* in the right-left direction about the central axis (axis C2) of the steering shaft that extends in the upward-downward direction. In short, the steering mechanism 60 is a driving mechanism that changes the yaw angle (tilt angle) of the propeller shaft 3*a*.

Figure 4:
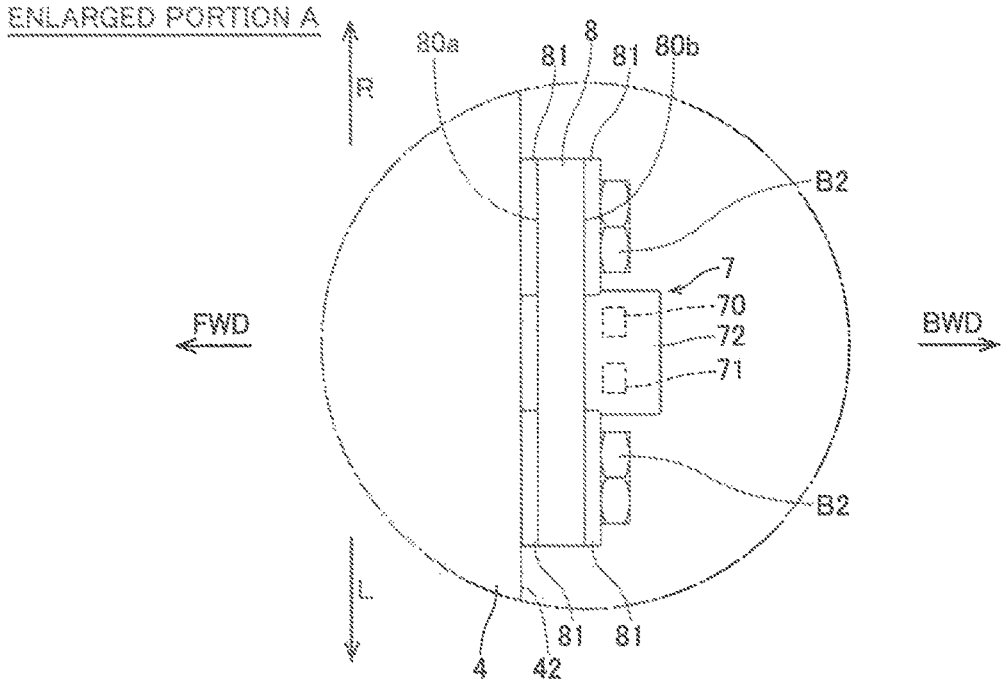
FIG. 4 is an enlarged view of a portion A in FIG. 3.

As shown in FIGS. 3 and 4, the IMU 7 includes the triaxial acceleration sensor 70, the triaxial angular velocity sensor 71, and a unit case 72 that houses and unitizes the triaxial acceleration sensor 70 and the triaxial angular velocity sensor 71.

The triaxial acceleration sensor 70 is a MEMS sensor that measures accelerations in three directions of X, Y, and Z axes. A measurement value of the triaxial acceleration sensor 70 is used by the ECU 9 to adjust the tilt angle of the propeller shaft 3*a*.

The triaxial angular velocity sensor 71 is a MEMS sensor that measures the actual tilt angle of a device (such as the outboard motor body 102*a* or the propeller 3) in which the triaxial angular velocity sensor 71 is installed. A measurement value of the triaxial angular velocity sensor 71 is used by the ECU 9 to adjust the tilt angle of the propeller shaft 3*a*.

The unit case 72 is a small case that is sufficiently smaller than the engine 4. Therefore, the triaxial acceleration sensor 70 and the triaxial angular velocity sensor 71 housed in the unit case 72 are disposed in the vicinity of each other. The unit case 72 (the triaxial acceleration sensor 70 and the triaxial angular velocity sensor 71) is fixed to the bracket 8 by bolts B1, and is indirectly installed on the rear side surface 42 of the engine 4 via the bracket 8. The unit case 72 (the triaxial acceleration sensor 70 and the triaxial angular velocity sensor 71) is disposed outside the intake paths 4*a* of the engine 4 in the cowling 5.

The unit case 72 (the triaxial acceleration sensor 70 and the triaxial angular velocity sensor 71) is indirectly installed on the rear side surface 42 of the engine 4 via vibration dampers 81 (see FIG. 4) described below.

The unit case 72 is made of a resin. That is, the unit case 72 is made of a material, the temperature of which is relatively unlikely to increase due to heat transferred from the engine 4. Therefore, an increase in the temperatures of the triaxial acceleration sensor 70 and the triaxial angular velocity sensor 71 is also significantly reduced or prevented.

Figure 5:
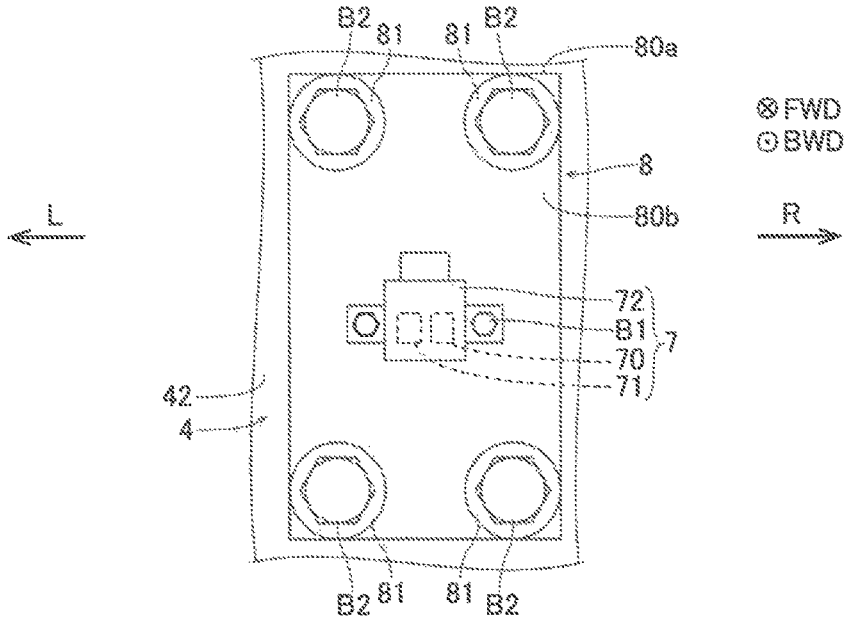
FIG. 5 is a diagram showing an IMU and a bracket of the outboard motor according to the first preferred embodiment of the present invention, as viewed from the rear.

As shown in FIG. 5, the IMU 7 (the triaxial acceleration sensor 70 and the triaxial angular velocity sensor 71) is installed on (fixed to) the bracket 8. The bracket 8 has a rectangular flat plate shape. The bracket 8 is fixed to the rear side surface 42 of the engine 4 by bolts B2 installed at four corners of the rectangular shape.

A first surface 80*a* of the bracket 8 perpendicular to the thickness direction thereof is disposed along the rear side surface 42 of the engine 4, and faces the rear side surface 42 of the engine 4. The IMU 7 (unit case 72) is fixed to a substantially central portion of a second surface 80*b* of the bracket 8 by the bolts B1.

Annular vibration dampers 81 are provided on the bracket 8. The vibration dampers 81 are made of an elastic body that significantly reduces or prevents transmission of vibrations of the engine 4 to the triaxial acceleration sensor 70 and the triaxial angular velocity sensor 71. As an example, the vibration dampers 81 are made of a rubber material.

The annular vibration dampers 81 are disposed on opposite sides of mounting holes of the bolts B2 of the bracket 8, and are fixed to the bracket 8 by inserting the bolts B2. The annular vibration dampers 81 are disposed at all four corners of the bracket 8 having a rectangular shape.

The bracket 8 is made of a resin. That is, the bracket 8 is made of a material, the temperature of which is relatively unlikely to increase due to heat transferred from the engine 4. Therefore, an increase in the temperatures of the triaxial acceleration sensor 70 and the triaxial angular velocity sensor 71 is also significantly reduced or prevented.

The ECU 9 performs a control to adjust the tilt angle (the pitch angle and the yaw angle) of the propeller shaft 3*a* based on the measurement values of the triaxial acceleration sensor 70 and the triaxial angular velocity sensor 71.

Figure 6:
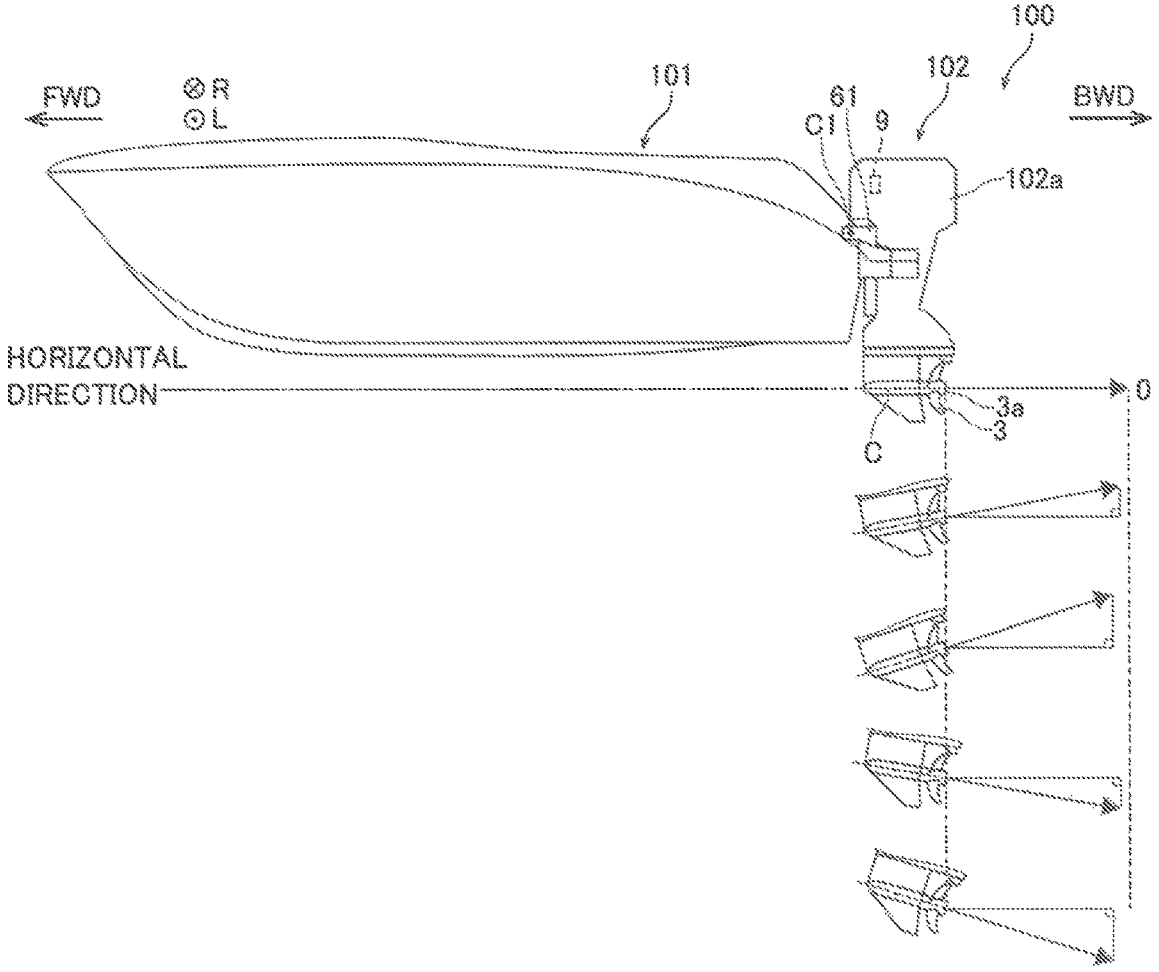
FIG. 6 is a diagram illustrating adjustment of the pitch angle of a propeller by an ECU of the outboard motor according to the first preferred embodiment of the present invention.

As shown in FIG. 6, the ECU 9 acquires the horizontal direction of the hull 101 using the triaxial acceleration sensor 70 (see FIG. 1) and detects the tilt angle (pitch angle) of the propeller shaft 3*a* with respect to the horizontal direction acquired by the triaxial acceleration sensor 70 using the triaxial angular velocity sensor 71 (see FIG. 1) so as to control the trim mechanism 61 to adjust the tilt angle (pitch angle) of the propeller shaft 3*a*. The gravity direction of the hull 101 is acquired by the triaxial acceleration sensor 70, and thus the horizontal direction of the hull 101 is acquired as a direction perpendicular to the gravity direction.

Specifically, the ECU 9 detects, using the triaxial angular velocity sensor 71, the tilt angle (pitch angle) of the propeller shaft 3*a* with respect to the horizontal direction acquired by the triaxial acceleration sensor 70 so as to perform a control to move the tilt angle (pitch angle) of the propeller shaft 3*a* closer to the horizontal direction acquired by the triaxial acceleration sensor 70 such that the thrust force of the propeller 3 is along the horizontal direction. Finally, the ECU 9 performs a control to match the tilt angle (pitch angle) of the propeller shaft 3*a* with the horizontal direction acquired by the triaxial acceleration sensor 70.

In this state, the marine vessel 100 is propelled by a thrust force from the outboard motor 102. The ECU 9 drives the trim mechanism 61 to rotate the outboard motor body 102*a* (see FIG. 1) about the axis C1 that extends in the right-left direction so as to perform a control to move the tilt angle (pitch angle) of the propeller shaft 3*a* closer to the horizontal direction and match the same with the horizontal direction.

When the thrust force obtained by the propeller 3 is Th, a horizontal component of the thrust force increases as the tilt angle (pitch angle) of the propeller shaft 3*a* (the rotation center axis C of the propeller 3) approaches the horizontal direction.

Figure 7:
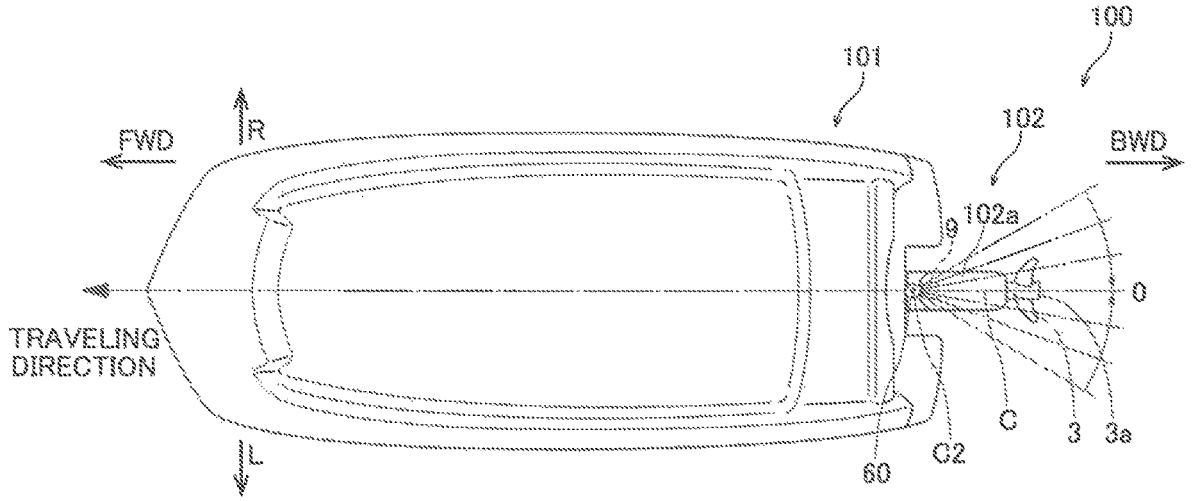
FIG. 7 is a diagram illustrating adjustment of the yaw angle of the propeller by the ECU of the outboard motor according to the first preferred embodiment of the present invention.

As shown in FIG. 7, the ECU 9 acquires the traveling direction of the hull 101 using the triaxial acceleration sensor 70 and detects, using the triaxial angular velocity sensor 71, the tilt angle (yaw angle) of the propeller shaft 3*a* with respect to the traveling direction acquired by the triaxial acceleration sensor 70 so as to control the steering mechanism 60 to adjust the tilt angle (yaw angle) of the propeller shaft 3*a*.

Specifically, the ECU 9 detects, using the triaxial angular velocity sensor 71, the tilt angle (yaw angle) of the propeller shaft 3*a* with respect to the traveling direction acquired by the triaxial acceleration sensor 70 so as to perform a control to move the tilt angle (yaw angle) of propeller shaft 3*a* closer to the traveling direction acquired by the triaxial acceleration sensor 70 such that the thrust force of the propeller 3 is along the traveling direction. Finally, the ECU 9 performs a control to match the tilt angle (yaw angle) of the propeller shaft 3*a* with the traveling direction acquired by the triaxial acceleration sensor 70.

In this state, the marine vessel 100 is propelled by a thrust force from the outboard motor 102. The ECU 9 drives the steering mechanism 60 to rotate the outboard motor body 102*a* (see FIG. 1) in the right-left direction about the axis C2 that extends in the upward-downward direction so as to perform a control to move the tilt angle (yaw angle) of the propeller shaft 3*a* closer to the traveling direction and match the same with the traveling direction.

According to the first preferred embodiment of the present invention, the following advantageous effects are achieved.

According to the first preferred embodiment of the present invention, the outboard motor 102 includes the tilting mechanism (the trim mechanism 61 and the steering mechanism 60) that changes the tilt angle of the propeller shaft 3*a* by moving the outboard motor body 102*a* with respect to the hull 101 and the triaxial acceleration sensor 70 and the triaxial angular velocity sensor 71 installed in the outboard motor body 102*a*. Accordingly, the triaxial acceleration sensor 70 and the triaxial angular velocity sensor 71 are installed in the outboard motor body 102*a* instead of the hull 101, and thus it is not necessary to correct the measurement value of the attitude angle sensor (IMU, i.e., the acceleration sensor and the angular velocity sensor) installed on the hull with the mounting angle of the outboard motor with respect to the hull measured manually, unlike the related art. That is, the tilt angle of the propeller shaft 3*a* is directly detected by the triaxial acceleration sensor 70 and the triaxial angular velocity sensor 71 directly installed in the outboard motor body 102*a*, and thus an error in detection of the tilt angle of the propeller shaft 3*a* includes only an error in measurement by each of the triaxial acceleration sensor 70 and the triaxial angular velocity sensor 71. Furthermore, it is not necessary to manually measure the mounting angle of the outboard motor 102 with respect to the hull 101. Thus, the workload on a user who manually measures the mounting angle of the outboard motor 102 with respect to the hull 101 is reduced, and the detection accuracy of the tilt angle of the propeller shaft 3*a* is improved.

According to the first preferred embodiment of the present invention, the ECU 9 performs a control to move the tilt angle of the propeller shaft 3*a* closer to the traveling direction and move the tilt angle of the propeller shaft 3*a* closer to the horizontal direction. Accordingly, the tilt angle of the propeller shaft 3*a* with respect to the reference direction (the gravity direction, the traveling direction, or the horizontal direction) is reduced, and propulsion of the marine vessel 100 with the propeller shaft 3*a* being tilted is significantly reduced or prevented. Therefore, the marine vessel 100 is stably propelled.

According to the first preferred embodiment of the present invention, the ECU 9 performs a control to match the tilt angle of the propeller shaft 3*a* with the traveling direction and match the tilt angle of the propeller shaft 3*a* with the horizontal direction. Accordingly, the tilt angle of the propeller shaft 3*a* is matched with the reference direction (the gravity direction, the traveling direction, or the horizontal direction), and propulsion of the marine vessel 100 with the propeller shaft 3*a* being tilted is prevented. Therefore, the marine vessel 100 is more stably propelled.

According to the first preferred embodiment of the present invention, the ECU 9 acquires the horizontal direction using the triaxial acceleration sensor 70 and detects the pitch angle of the propeller shaft 3*a* with respect to the horizontal direction as viewed in the right-left direction using the triaxial angular velocity sensor 71 so as to perform a control to move the pitch angle of the propeller shaft 3*a* closer to the horizontal direction such that the thrust force of the propeller 3 is along the horizontal direction. Accordingly, the thrust force of the propeller 3 is along the horizontal direction such that a component of the thrust force of the propeller 3 in the gravity direction (upward-downward direction) is reduced. Consequently, a loss in the thrust force of the propeller 3 is reduced, and the marine vessel 100 is efficiently propelled.

According to the first preferred embodiment of the present invention, the tilting mechanism includes the trim mechanism 61 that changes the tilt angle of the propeller shaft 3*a* by rotating the outboard motor body 102*a* in the upward-downward direction about the axis C1 that extends in the right-left direction, and the ECU 9 drives the trim mechanism 61 and performs a control to move the pitch angle of the propeller shaft 3*a* closer to the horizontal direction. Accordingly, the trim mechanism 61 easily changes the pitch angle of the propeller shaft 3*a* to adjust the tilt angle of the propeller shaft 3*a*.

According to the first preferred embodiment of the present invention, the ECU 9 acquires the traveling direction using the triaxial acceleration sensor 70 and detects the yaw angle of the propeller shaft 3*a* with respect to the traveling direction as viewed in the upward-downward direction using the triaxial angular velocity sensor 71 so as to perform a control to move the yaw angle of the propeller shaft 3*a* closer to the traveling direction such that the thrust force of the propeller 3 is along the traveling direction. Accordingly, the thrust force of the propeller 3 is along the traveling direction such that the marine vessel 100 is propelled linearly (propelled straight) without steering (without check helm) when the wind is relatively weak. That is, the marine vessel 100 is easily operated.

According to the first preferred embodiment of the present invention, the tilting mechanism includes the steering mechanism 60 that changes the tilt angle of the propeller shaft 3*a* by rotating the outboard motor body 102*a* in the right-left direction about the axis C2 that extends in the upward-downward direction, and the ECU 9 drives the steering mechanism 60 and performs a control to move the yaw angle of the propeller shaft 3*a* closer to the traveling direction. Accordingly, the steering mechanism 60 easily changes the yaw angle of the propeller shaft 3*a* to adjust the tilt angle of the propeller shaft 3*a*.

According to the first preferred embodiment of the present invention, the outboard motor 102 further includes the unit case 72 that houses and unitizes the triaxial acceleration sensor 70 and the triaxial angular velocity sensor 71. Accordingly, the unit case 72 unitizes the triaxial acceleration sensor 70 and the triaxial angular velocity sensor 71 such that the triaxial acceleration sensor 70 and the triaxial angular velocity sensor 71 are easily installed.

According to the first preferred embodiment of the present invention, the outboard motor 102 further includes the cowling 5 that houses the engine 4, and the triaxial acceleration sensor 70 and the triaxial angular velocity sensor 71 are housed in the cowling 5. Accordingly, the triaxial acceleration sensor 70 and the triaxial angular velocity sensor 71 are disposed at relatively easily accessible positions (easily reachable positions) inside the outboard motor 102.

According to the first preferred embodiment of the present invention, the triaxial acceleration sensor 70 and the triaxial angular velocity sensor 71 are disposed above the lower end 5*a* of the cowling 5 so as to prevent contact with water. Accordingly, contact of the triaxial acceleration sensor 70 and the triaxial angular velocity sensor 71 with water is prevented.

According to the first preferred embodiment of the present invention, the triaxial acceleration sensor 70 and the triaxial angular velocity sensor 71 are installed on the rear side surface 42 of the engine 4. Accordingly, the triaxial acceleration sensor 70 and the triaxial angular velocity sensor 71 are easily installed at positions inside the cowling 5 that water does not contact.

According to the first preferred embodiment of the present invention, the triaxial acceleration sensor 70 and the triaxial angular velocity sensor 71 are installed on the engine 4 via the vibration dampers 81 made of the elastic body that significantly reduces or prevents transmission of vibrations of the engine 4 to the triaxial acceleration sensor 70 and the triaxial angular velocity sensor 71. Accordingly, transmission of vibrations of the engine 4 to the triaxial acceleration sensor 70 and the triaxial angular velocity sensor 71 is significantly reduced or prevented by the vibration dampers 81.

According to the first preferred embodiment of the present invention, the outboard motor 102 further includes the bracket 8 on which the triaxial acceleration sensor 70 and the triaxial angular velocity sensor 71 are installed, and the bracket 8 is made of a resin and is fixed to the engine 4 via the vibration dampers 81. Accordingly, an increase in the temperatures of the triaxial acceleration sensor 70 and the triaxial angular velocity sensor 71 due to the heat of the engine 4 is significantly reduced or prevented by the bracket 8 made of a resin while transmission of vibrations of the engine 4 to the triaxial acceleration sensor 70 and the triaxial angular velocity sensor 71 is significantly reduced or prevented by the vibration dampers 81.

According to the first preferred embodiment of the present invention, the triaxial acceleration sensor 70 and the triaxial angular velocity sensor 71 are disposed outward of the intake paths 4*a* in the cowling 5. Accordingly, vibrations of the triaxial acceleration sensor 70 and the triaxial angular velocity sensor 71 due to intake air that passes through the intake paths 4*a* are prevented.

Second Preferred Embodiment

The structure of a marine vessel 200 including an outboard motor 202 according to a second preferred embodiment of the present invention is now described with reference to FIGS. 8 and 9. In the second preferred embodiment, in addition to the structure of the first preferred embodiment in which the ECU 9 performs a control to adjust the pitch angle and the yaw angle of the propeller shaft 3*a*, an EUC 209 performs a control to adjust the roll angle of a drive shaft D. In the second preferred embodiment, the same or similar structures as those of the first preferred embodiment are denoted by the same reference numerals, and description thereof is omitted.

Figure 8:
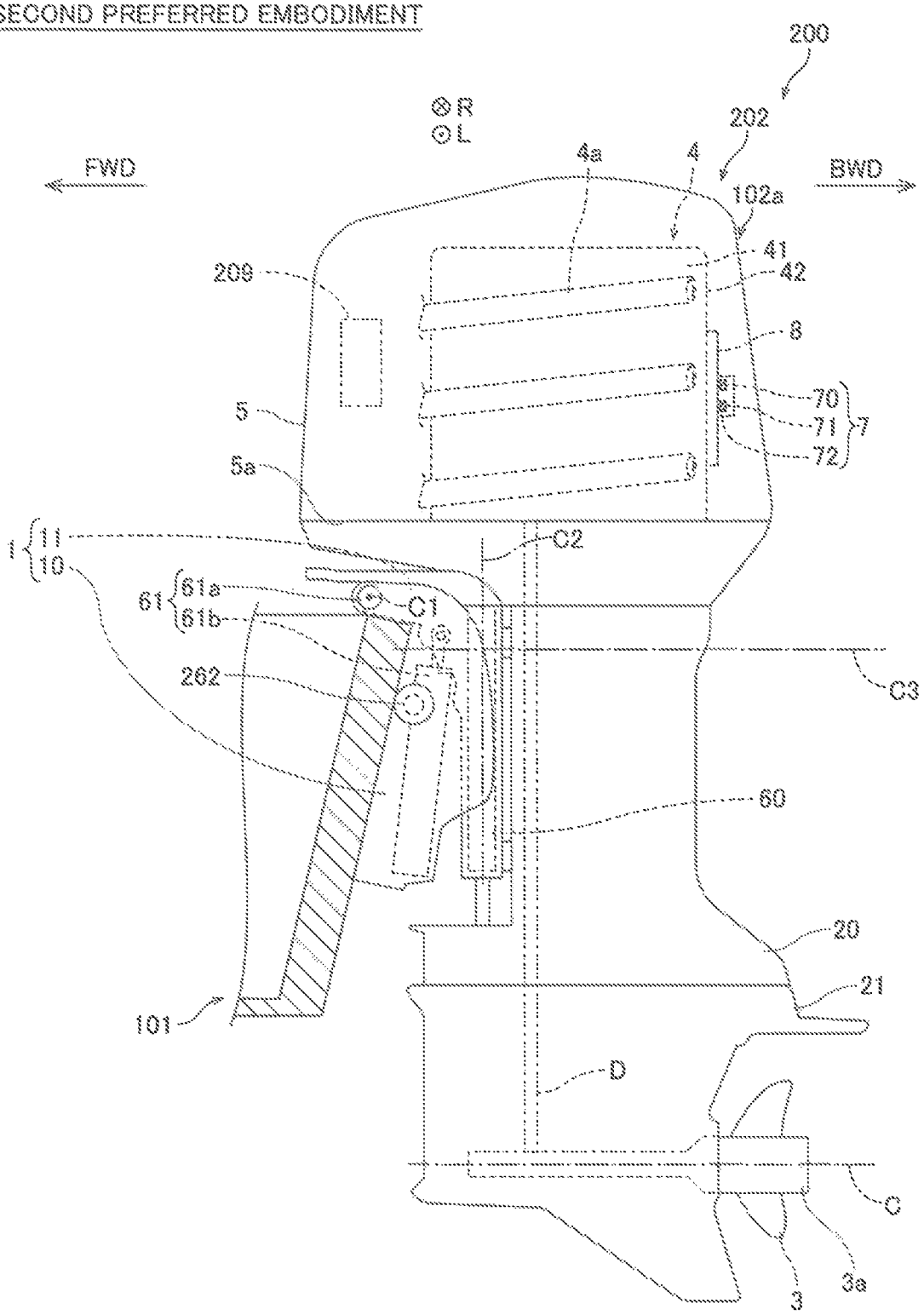
FIG. 8 is a side view showing the structure of the outboard motor according to the second preferred embodiment of the present invention.

As shown in FIG. 8, the marine vessel 200 according to the second preferred embodiment includes the outboard motor 202. The outboard motor 202 includes a rolling mechanism 262 and the ECU 209. The rolling mechanism 262 is an example of a "tilting mechanism".

The rolling mechanism 262 changes the tilt angle (roll angle) of the drive shaft D (hull 101) by rotating an outboard motor body 102*a* in a right-left direction about an axis C3 that extends in a forward-rearward direction.

Specifically, the rolling mechanism 262 is installed at the stern, and includes a cylinder that rotates a fixed bracket 10. The axis C3 passes through the fixed bracket 10, and is located at the center of the fixed bracket 10 in the right-left direction. The rolling mechanism 262 changes the tilt angle (roll angle) of the drive shaft D by rotating the outboard motor body 102*a* in the right-left direction about the axis C3 that passes through the fixed bracket 10 that supports the outboard motor body 102*a*.

The ECU 209 performs a control to adjust the tilt angle (roll angle) of the drive shaft D based on measurement values of a triaxial acceleration sensor 70 and a triaxial angular velocity sensor 71.

Figure 9:
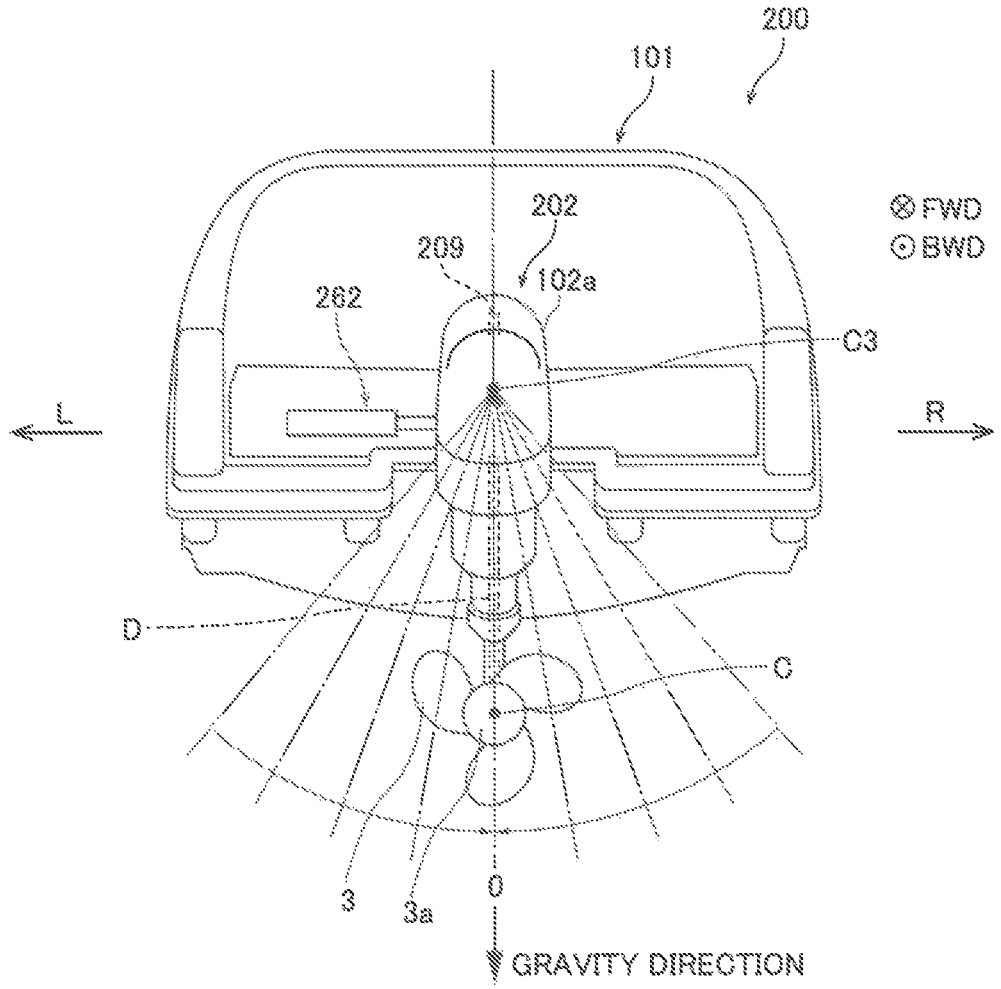
FIG. 9 is a diagram illustrating adjustment of the roll angle of a propeller by an ECU of the outboard motor according to the second preferred embodiment of the present invention.

As shown in FIG. 9, the ECU 209 acquires the gravity direction of the drive shaft D (outboard motor body 102*a*) using the triaxial acceleration sensor 70 (see FIG. 8) and detects the tilt angle (roll angle) of the drive shaft D with respect to the gravity direction acquired by the triaxial acceleration sensor 70 using the triaxial angular velocity sensor 71 (see FIG. 8) so as to control the rolling mechanism 262 to adjust the tilt angle (roll angle) of the drive shaft D.

Specifically, the ECU 209 detects, using the triaxial angular velocity sensor 71, the tilt angle (roll angle) of the drive shaft D with respect to the gravity direction acquired by the triaxial acceleration sensor 70 so as to perform a control to move the tilt angle (roll angle) of the drive shaft D closer to the gravity direction acquired by the triaxial acceleration sensor 70. Finally, the ECU 209 performs a control to match the tilt angle (roll angle) of the drive shaft D with the gravity direction acquired by the triaxial acceleration sensor 70.

In this state, the marine vessel 200 is propelled by a thrust force from the outboard motor 202. The ECU 209 drives the rolling mechanism 262 to rotate the outboard motor body 102*a* (see FIG. 1) about the axis C3 that extends in the right-left direction so as to perform a control to move the tilt angle (roll angle) of the drive shaft D closer to the gravity direction and match the same with the gravity direction.

The remaining structures of the second preferred embodiment are similar to those of the first preferred embodiment.

According to the second preferred embodiment of the present invention, the following advantageous effects are achieved.

According to the second preferred embodiment of the present invention, the outboard motor 202 includes the tilting mechanism (a trim mechanism 61, a steering mechanism 60, and the rolling mechanism 262) that changes the tilt angles of a propeller shaft 3*a* and the drive shaft D by moving the outboard motor body 102*a* with respect to the hull 101, and the triaxial acceleration sensor 70 and the triaxial angular velocity sensor 71 installed in the outboard motor body 102*a*. Accordingly, the workload on a user who manually measures the mounting angle of the outboard motor 202 with respect to the hull 101 is reduced, and the detection accuracy of the tilt angles of the propeller shaft 3*a* and the drive shaft D is improved.

According to the second preferred embodiment of the present invention, the ECU 209 acquires the gravity direction using the triaxial acceleration sensor 70 and detects the roll angle of the drive shaft D with respect to the gravity direction as viewed in the forward-rearward direction using the triaxial angular velocity sensor 71 so as to perform a control to move the roll angle of the drive shaft D closer to the gravity direction. Accordingly, the propeller shaft 3*a* is disposed in a balanced manner with respect to the hull 101 in the right-left direction (when there is one outboard motor 202, the propeller shaft 3*a* is disposed at the center with respect to the hull 101), and thus the marine vessel 200 is easily propelled linearly (propelled straight). In addition, a large turn is significantly reduced or prevented such that the marine vessel 200 is stably propelled.

The remaining advantageous effects of the second preferred embodiment are similar to those of the first preferred embodiment.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the triaxial acceleration sensor and the triaxial angular velocity sensor are preferably installed on the rear side surface of the engine in each of the first and second preferred embodiments described above, the present invention is not restricted to this. In the present invention, the triaxial acceleration sensor and the triaxial angular velocity sensor may alternatively be installed on the front side surface, left side surface (between the intake paths and the engine), right side surface, or upper surface of the engine. Note that the triaxial acceleration sensor and the triaxial angular velocity sensor may be installed inside the upper case or the lower case as long as the watertight state is maintained.

While the unit case preferably unitizes the triaxial acceleration sensor and the triaxial angular velocity sensor in each of the first and second preferred embodiments described above, the present invention is not restricted to this. In the present invention, the triaxial acceleration sensor and the triaxial angular velocity sensor may alternatively be separately installed without using the unit case.

While the triaxial acceleration sensor and the triaxial angular velocity sensor are disposed in the vicinity of each other in each of the first and second preferred embodiments described above, the present invention is not restricted to this. In the present invention, the triaxial acceleration sensor and the triaxial angular velocity sensor may not be disposed in the vicinity of each other but may be disposed at positions relatively spaced apart from each other.

While one outboard motor is preferably installed on the hull in each of the first and second preferred embodiments described above, the present invention is not restricted to this. In the present invention, a plurality of outboard motors may alternatively be installed on the hull.

While the controller is preferably the ECU in each of the first and second preferred embodiments described above, the present invention is not restricted to this. In the present invention, the controller may alternatively be a structure different from the ECU.

While the vibration dampers are preferably made of a rubber material in each of the first and second preferred embodiments described above, the present invention is not restricted to this. In the present invention, the vibration dampers may alternatively be made of a spring material, for example.

While the bracket is preferably fixed to the engine by the bolts in each of the first and second preferred embodiments described above, the present invention is not restricted to this. In the present invention, the bracket may alternatively be fixed to the engine by adhesion, for example.

While the mechanism that changes the roll angle preferably includes the mechanism that rotates the fixed bracket by the cylinder in the second preferred embodiment described above, the present invention is not restricted to this. In the present invention, the mechanism that changes the roll angle may alternatively include a mechanism including a rotation shaft that extends in the forward-rearward direction and supports the outboard motor body, and a drive that rotates the rotation shaft, for example.

While the ECU (controller) preferably performs a control to move the tilt angle of the propeller (drive shaft) closer to the traveling direction and the horizontal direction (gravity direction) acquired by the triaxial acceleration sensor in each of the first and second preferred embodiments described above, the present invention is not restricted to this. In the present invention, the controller may alternatively be configured or programmed to perform a control to move the tilt angle of the propeller (drive shaft) away from the traveling direction and the horizontal direction (gravity direction) acquired by the triaxial acceleration sensor. In addition, the controller may alternatively be configured or programmed to perform a control to move the tilt angle of the propeller (drive shaft) closer to a predetermined angle with respect to the traveling direction and the horizontal direction (gravity direction) acquired by the triaxial acceleration sensor.

While the bracket preferably has a rectangular shape in each of the first and second preferred embodiments described above, the present invention is not restricted to this. In the present invention, the bracket may alternatively have a circular shape or a tubular shape.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor mountable on a hull, comprising:

an engine;

a propeller driven by the engine via a drive shaft and a propeller shaft;

a tilting mechanism that changes a tilt angle of at least one of the propeller shaft and the drive shaft by moving an outboard motor body of the outboard motor with respect to the hull;

a triaxial acceleration sensor and a triaxial angular velocity sensor installed in the outboard motor body; and a controller configured or programmed to acquire at least one of a gravity direction, a traveling direction, or a horizontal direction of the hull using the triaxial acceleration sensor, and detect at least one of a first angle of the drive shaft with respect to the gravity direction, a second angle of the propeller shaft with respect to the traveling direction, or a third angle of the propeller shaft with respect to the horizontal direction using the triaxial angular velocity sensor, to thereby control the tilting mechanism to adjust the tilt angle of at least one of the drive shaft and the propeller shaft.

2. The outboard motor according to claim 1, wherein the controller is configured or programmed to perform at least one of a control to move the tilt angle of the drive shaft so that a drive shaft direction, which is a direction that the drive shaft is in, is closer to the gravity direction, a control to move the tilt angle of the propeller shaft so that a propeller shaft direction, which is a direction that the propeller shaft is in, is closer to the traveling direction, or a control to move the tilt angle of the propeller shaft so that the propeller shaft direction is closer to the horizontal direction.

3. The outboard motor according to claim 2, wherein the controller is configured or programmed to perform at least one of a control to match the drive shaft direction with the gravity direction, a control to match the propeller shaft direction with the traveling direction, or a control to match the propeller shaft direction with the horizontal direction.

4. The outboard motor according to claim 2, wherein the third angle of the propeller shaft with respect to the horizontal direction is a pitch angle of the propeller shaft with respect to the horizontal direction as viewed in a right-left direction of the outboard motor body, and the controller is configured or programmed to perform a control to move the pitch angle of the propeller shaft so that the propeller shaft direction is closer to the horizontal direction and a thrust force of the propeller is along the horizontal direction.

5. The outboard motor according to claim 4, wherein the tilting mechanism includes a trim mechanism that changes the tilt angle of the propeller shaft by rotating the outboard motor body in an upward-downward direction of the outboard motor body about an axis that extends in the right-left direction; and the controller is configured or programmed to drive the trim mechanism to move the pitch angle of the propeller shaft so that the propeller shaft direction is closer to the horizontal direction.

6. The outboard motor according to claim 2, wherein the second angle of the propeller shaft with respect to the traveling direction is a yaw angle of the propeller shaft with respect to the traveling direction as viewed in an upward-downward direction of the outboard motor body, and the controller is configured or programmed to perform a control to move the yaw angle of the propeller shaft so that the propeller shaft direction is closer to the traveling direction and a thrust force of the propeller is along the traveling direction.

7. The outboard motor according to claim 6, wherein the tilting mechanism includes a steering mechanism that changes the tilt angle of the propeller shaft by rotating the outboard motor body in a right-left direction of the outboard motor body about an axis that extends in the upward-downward direction; and the controller is configured or programmed to drive the steering mechanism to move the yaw angle of the propeller shaft so that the propeller shaft direction is closer to the traveling direction.

8. The outboard motor according to claim 2, wherein the first angle of the drive shaft with respect to the gravity direction is a roll angle of the drive shaft with respect to the gravity direction as viewed in a forward-rearward direction of the outboard motor body, and the controller is configured or programmed to perform a control to move the roll angle of the drive shaft so that the drive shaft direction is closer to the gravity direction.

9. The outboard motor according to claim 1, further comprising:

a unit case that houses and unitizes the triaxial acceleration sensor and the triaxial angular velocity sensor.

10. The outboard motor according to claim 1, further comprising:

a cowling that houses the engine, wherein the triaxial acceleration sensor and the triaxial angular velocity sensor are housed in the cowling.

11. The outboard motor according to claim 10, wherein the triaxial acceleration sensor and the triaxial angular velocity sensor are disposed above a lower end of the cowling so as to be out of contact with water.

12. The outboard motor according to claim 11, wherein the triaxial acceleration sensor and the triaxial angular velocity sensor are installed on a left side surface, a right side surface, a rear side surface, a front side surface or an upper surface of the engine.

13. The outboard motor according to claim 10, wherein the triaxial acceleration sensor and the triaxial angular velocity sensor are installed on the engine via a vibration damper made of an elastic body that reduces or prevents transmission of a vibration of the engine to the triaxial acceleration sensor and the triaxial angular velocity sensor.

14. The outboard motor according to claim 13, further comprising:

a bracket on which the triaxial acceleration sensor and the triaxial angular velocity sensor are installed, the bracket being made of a resin and being fixed to the engine via the vibration damper.

15. The outboard motor according to claim 10, wherein the triaxial acceleration sensor and the triaxial angular velocity sensor are disposed outward of an intake path in the cowling.

16. A marine vessel comprising:

a hull; and an outboard motor installed on the hull, the outboard motor including an engine;

a propeller driven by the engine via a drive shaft and a propeller shaft;

a tilting mechanism that changes a tilt angle of at least one of the propeller shaft and the drive shaft by moving an outboard motor body of the outboard motor with respect to the hull;

a triaxial acceleration sensor and a triaxial angular velocity sensor installed in the outboard motor body; and a controller configured or programmed to acquire at least one of a gravity direction, a traveling direction, or a horizontal direction of the hull using the triaxial acceleration sensor, and detect at least one of a first angle of the drive shaft with respect to the gravity direction, a second angle of the propeller shaft with respect to the traveling direction, or a third angle of the propeller shaft with respect to the horizontal direction using the triaxial angular velocity sensor, to thereby control the tilting mechanism to adjust the tilt angle of at least one of the drive shaft and the propeller shaft.

17. The marine vessel according to claim 16, wherein the controller is configured or programmed to perform at least one of a control to move the tilt angle of the drive shaft so that a drive shaft direction, which is a direction that the drive shaft is in, is closer to the gravity direction, a control to move the tilt angle of the propeller shaft so that a propeller shaft direction, which is a direction that the propeller shaft is in, is closer to the traveling direction, or a control to move the tilt angle of the propeller shaft so that the propeller shaft direction is closer to the horizontal direction.

18. The marine vessel according to claim 16, wherein the controller is configured or programmed to perform at least one of a control to match the drive shaft direction with the gravity direction, a control to match the propeller shaft direction with the traveling direction, or a control to match the propeller shaft direction with the horizontal direction.

19. The marine vessel according to claim 17, wherein the third angle of the propeller shaft with respect to the horizontal direction is a pitch angle of the propeller shaft with respect to the horizontal direction as viewed in a right-left direction of the outboard motor body, and the controller is configured or programmed to perform a control to move the pitch angle of the propeller shaft so that the propeller shaft direction is closer to the horizontal direction, and a thrust force of the propeller is along the horizontal direction.

20. The marine vessel according to claim 17, wherein the second angle of the propeller shaft with respect to the traveling direction is a yaw angle of the propeller shaft with respect to the traveling direction as viewed in an upward-downward direction of the outboard motor body, and the controller is configured or programmed to perform a control to move the yaw angle of the propeller shaft so that the propeller shaft direction is closer to the traveling direction and a thrust force of the propeller is along the traveling direction.

* * * * *